US010669879B2

(12) United States Patent
Pitt

(10) Patent No.: US 10,669,879 B2
(45) Date of Patent: Jun. 2, 2020

(54) CONTROLLING TIP CLEARANCE IN A TURBINE

(71) Applicant: ROLLS-ROYCE plc, London (GB)

(72) Inventor: Simon Pitt, Derby (GB)

(73) Assignee: ROLLS-ROYCE PLC, London (GB)

( * ) Notice: Subject to any disclaimer, the term of this patent is extended or adjusted under 35 U.S.C. 154(b) by 176 days.

(21) Appl. No.: 15/844,745

(22) Filed: Dec. 18, 2017

(65) Prior Publication Data

US 2018/0195404 A1 Jul. 12, 2018

(30) Foreign Application Priority Data

Jan. 10, 2017 (GB) ..... 1700361.7

(51) Int. Cl.

| | |
|---|---|
| ***F01D 11/24*** | (2006.01) |
| *F01D 11/08* | (2006.01) |
| *F01D 11/20* | (2006.01) |
| *F01D 11/14* | (2006.01) |
| *F01D 9/06* | (2006.01) |

(52) U.S. Cl.

CPC ..... *F01D 11/24* (2013.01); *F01D 9/065* (2013.01); *F01D 11/08* (2013.01); *F01D 11/14* (2013.01); *F01D 11/20* (2013.01); *F05D 2240/11* (2013.01); *F05D 2260/201* (2013.01)

(58) Field of Classification Search

CPC ..... F01D 11/24; F01D 11/20; F01D 11/14; F01D 11/08; F01D 9/065

See application file for complete search history.

(56) References Cited

U.S. PATENT DOCUMENTS

| | | | | |
|---|---|---|---|---|
| 5,351,732 | A * | 10/1994 | Mills | F01D 11/24 415/115 |
| 6,863,495 | B2 | 3/2005 | Halliwell et al. | |
| 2009/0053035 | A1* | 2/2009 | Zhang | F01D 11/24 415/1 |
| 2013/0149123 | A1* | 6/2013 | Laurello | F01D 11/24 415/191 |
| 2013/0266418 | A1* | 10/2013 | Snook | F01D 11/24 415/1 |
| 2014/0271103 | A1* | 9/2014 | Tham | F02C 9/16 415/1 |
| 2016/0230658 | A1* | 8/2016 | Hanlon | F01D 25/30 |
| 2017/0023018 | A1* | 1/2017 | Miller | F02C 7/141 |

FOREIGN PATENT DOCUMENTS

| | | |
|---|---|---|
| GB | 1581566 | 12/1980 |
| WO | 9211444 | 7/1992 |

OTHER PUBLICATIONS

Great Britain Search Report dated Apr. 5, 2017, issued in GB Patent Application No. 1700361.7.

* cited by examiner

*Primary Examiner* — Ninh H. Nguyen
*Assistant Examiner* — Behnoush Haghighian
(74) *Attorney, Agent, or Firm* — Oliff PLC

(57) ABSTRACT

A turbine case cooling system comprises a manifold (21) radially adjacent a portion of a radially outer surface of the turbine case (26) and in fluid communication with one or more of radially inwardly directed outlets (25). The manifold (21) has a first inlet (22) and a second inlet (23). The first inlet (22) is obstructed by a first flow restrictor (22*a*) and the second inlet (23) is obstructed by a second flow restrictor (23*a*). The first inlet (22) includes a valve (24) upstream of the first flow restrictor (22*a*) and the valve is adjustable to control flow of fluid supply entering the first inlet (22).

12 Claims, 5 Drawing Sheets

CONTROLLING TIP CLEARANCE IN A TURBINE

CROSS-REFERENCE TO RELATED APPLICATION

This application is based upon and claims the benefit from priority from British Patent Application No. 1700361.7 filed 10 Jan. 2017, the entire contents of which are incorporated herein.

FIELD OF DISCLOSURE

The present disclosure concerns the control of clearance between a rotating turbine blade and a stationary shroud which surrounds the rotating turbine blade. More particularly, the disclosure concerns controlled cooling of these elements.

BACKGROUND

Gas turbine engines operate at high temperatures. Differential thermal expansion of components can influence the dimension of a clearance space between the tip of a turbine blade and a shroud. Leakage between the tip of a turbine blade and its shroud can result in a significant reduction in the turbine's efficiency. Consequences of contact between the blade tip and shroud can be life limiting for the components. There is a desire to maintain an optimum clearance space between the blade tip and shroud during the various operational stages of a gas turbine engine.

In some prior known arrangements, radial expansion of the shroud may be restricted by the presence of a radially outer turbine casing. The casing may connect, through radial struts, to segments of the shroud. Thermal expansion and contraction of the turbine casing may be controlled by the introduction of an air supply at a temperature which encourages a desired amount of thermal expansion or contraction of the casing when targeted at the casing from a radially outer side. One example of such an arrangement is known from the Applicant's own prior published U.S. Pat. No. 6,863,495 B2.

FIG. 1 illustrates schematically a prior known arrangement for cooling the casing of a turbine in a gas turbine engine. As shown in the Figure, a manifold 1 is connected to a supply of air via a variable control valve 2. For example, the supply of air is taken from the compressor. When the valve is opened, the air flows around the manifold 1 and into a number of segments 3 which are radially spaced from but in thermal communication with a turbine casing 4. The casing 4 may be connected to a turbine shroud (not shown) sitting within the casing 4 by means of one or more radially extending struts (not shown). Each segment 3 is provided with a plurality of impingement cooling holes 5 through which the air from the manifold 1 is directed at a radially outer wall of the casing 4. With the impinging air at a temperature different to that of the casing 4 thermal resizing of the casing 4 results. By means of the struts, segments of the shroud can be repositioned along a radius to accommodate thermal resizing of turbine blades enclosed by the shroud. The valve 2 is a two stop valve configurable to deliver a low flow during maximum take-off (MTO) operation of the gas turbine engine and a higher flow during a cruise operation of the gas turbine engine. The impingement cooling holes 5 serve to meter and restrict the higher flow delivery to the casing 4. It will be appreciated that the rate of flow of the air to the casing will influence the rate at and extent to which the casing can be caused to undergo thermal resizing.

BRIEF SUMMARY OF THE DISCLOSURE

In accordance with the present disclosure there is provided a turbine case cooling system comprising:

a manifold radially adjacent a portion of a radially outer surface of the turbine case and in fluid communication with one or more of radially inwardly directed outlets, a first inlet to the manifold and a second inlet to the manifold, the first inlet obstructed by a first flow restrictor and the second inlet obstructed by a second flow restrictor and the first inlet including a valve upstream of the first flow restrictor and adjustable to control flow of fluid supply entering the first inlet.

The first and/or second flow restrictors may be in the form of perforated plates which can be removably retained in the region of the inlets. This permits the system to be tuned by interchanging plates to provide one best suited in a given application of the system.

Since the flow for different engine operations can be controlled by interchangeable flow restrictors, the valve may have a simple open or closed configuration in contrast to the two stop valve of the prior art. Optionally, the valve may be configured to enable variable flow adjustment.

In an option, a single manifold completely encircles the turbine case. In another option, multiple arcuate manifolds may be arranged around a circumference of the turbine case, each arcuate manifold having a first inlet and a second inlet. In the latter described arrangement, the flow restrictors may be different for different manifolds allowing variable flows to be presented around the circumference of the turbine case.

The inlets may be in fluid communication with an upstream compressor of the gas turbine engine. The system may further include a controller configured to control the valve whereby to adjust flow of fluid entering the manifold during different operations of the gas turbine engine.

BRIEF DESCRIPTION OF DRAWINGS

An embodiment of the present disclosure will now be further described by way of example, with reference to the accompanying Figures in which.

DETAILED DESCRIPTION OF DRAWINGS AND EMBODIMENTS

Figure 1:
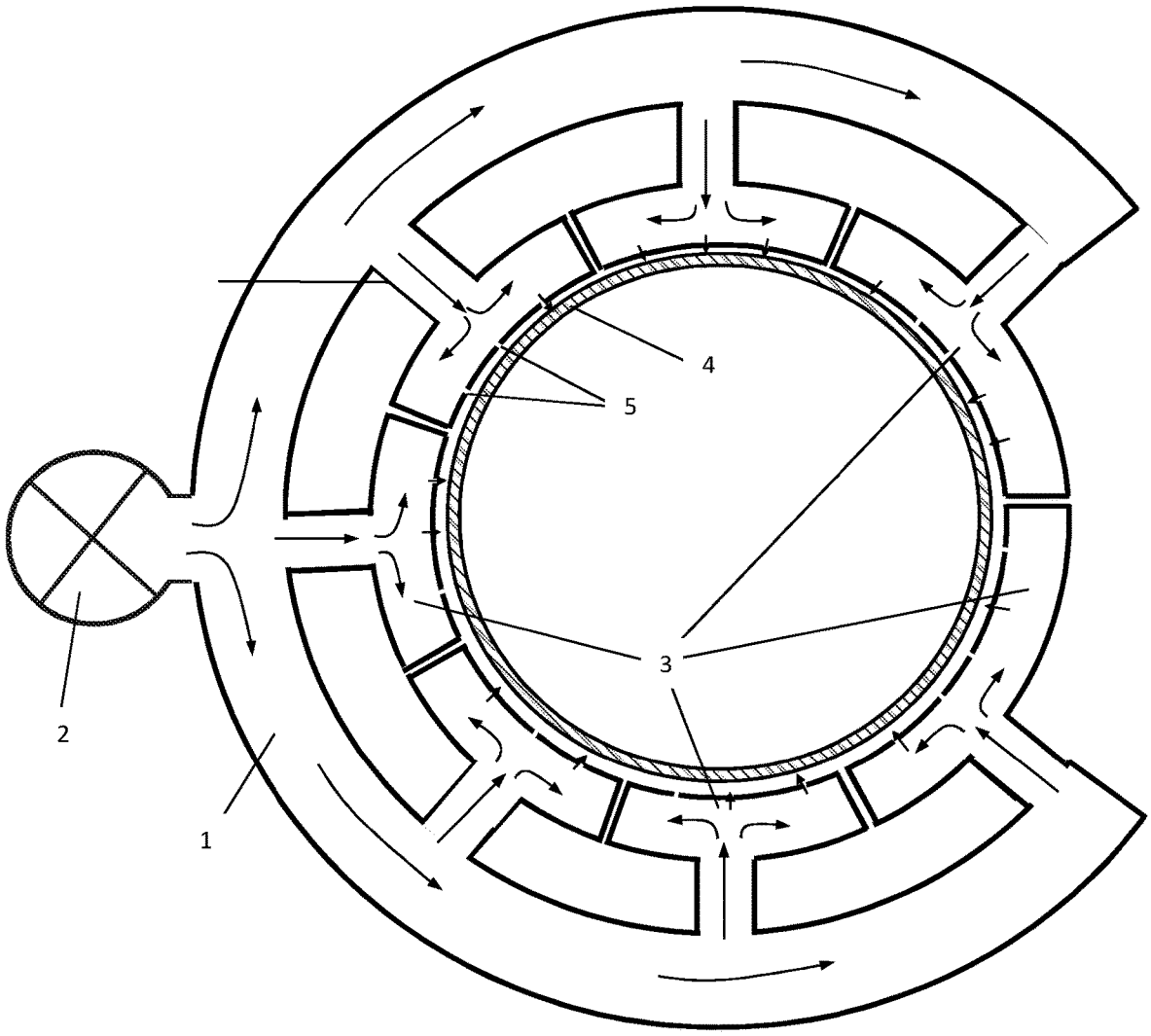
FIG. 1 shows a schematic of a turbine case cooling system as is known in the prior art.

FIG. 1 has been described above.

Figure 2:
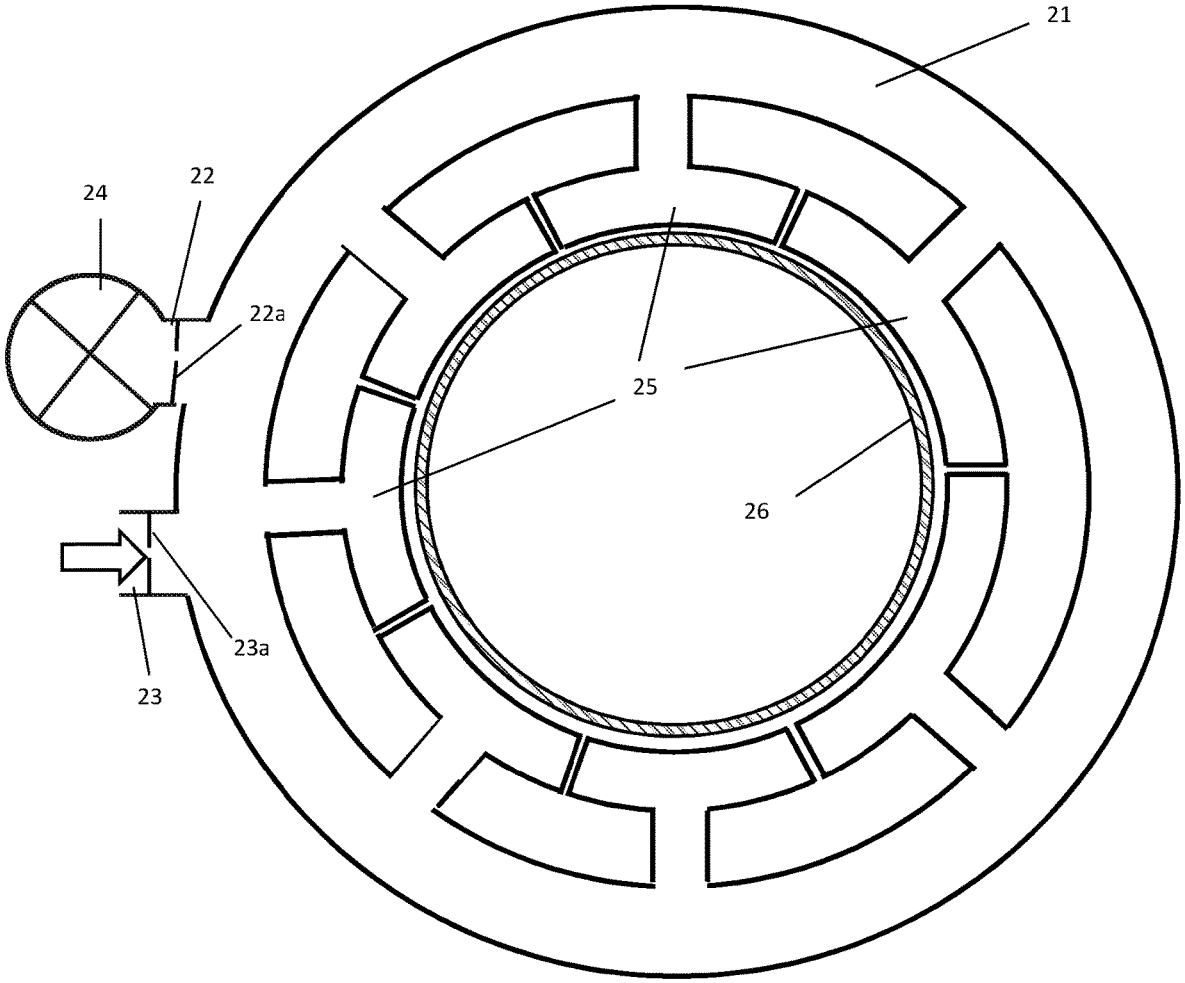
FIG. 2 shows a schematic of a first embodiment of a turbine case cooling system in accordance with the present disclosure.

FIG. 2 shows a turbine case cooling system in accordance with the present disclosure. For example (but without limitation), the system is suited to use in the region of a low pressure turbine of a gas turbine engine such as that shown in FIG. 5. The system comprises a ring-shaped manifold 21 in fluid communication with multiple radially inwardly directed outlet segments 25. The outlet segments are arrange radially adjacent a radially outer surface of an annular turbine casing 26. A first inlet 22 for supplying fluid to the manifold 21 is fitted with a valve 24. Just downstream of the valve 24 is a first flow restrictor plate 22*a*. A second inlet 23 is obstructed by a second flow restrictor plate 23*a*. The inlets 22, 23 are each connected to a fluid supply which may be the same supply. The cooling system surrounds a turbine which forms part of a gas turbine engine. The fluid supply may, for example, be taken from a section of a compressor (not shown) of the gas turbine engine located upstream of the turbine cooling system. During a MTO operation, flow of fluid into the manifold is drawn from the compressor through open second inlet 23. The flow rate entering the manifold 21 can be more accurately controlled by selective configuration of the second flow restrictor plate 23*a*. As the engine proceeds to a cruise operation, the valve 24 can be opened allowing a second source of fluid to enter the manifold 21, topping up what is already supplied through the second inlet 23. The flow rate entering the manifold 21 can be more accurately controlled by selective configuration of the first flow restrictor plate 22*a*.

Figure 3:
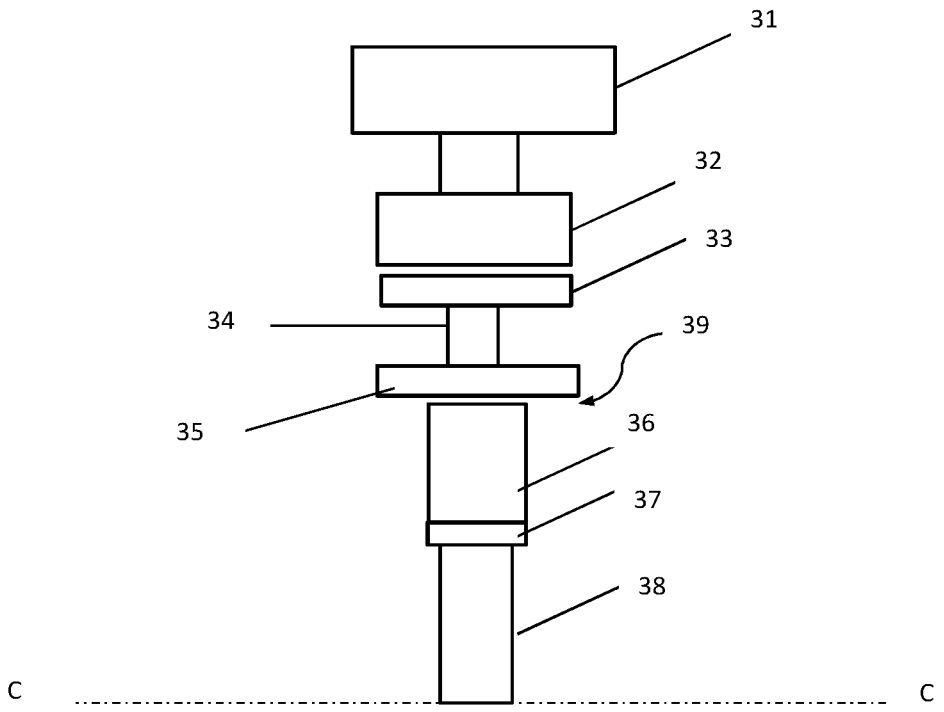
FIG. 3 shows an axial section of a turbine having a case cooling system similar to that shown in FIG. 2.

FIG. 3 shows schematically a section of a turbine and associated cooling system arranged in a gas turbine engine. As can be seen the turbine is arranged on an axis C-C. A manifold 31 is arranged radially distally from the axis C-C. The manifold 31 extends radially inwardly to an outlet 32. The outlet 32 is arranged radially adjacent and in thermal communication with an annular turbine casing 33. The casing 33 bears radially inwardly-directed struts 34, each strut 34 carries a turbine shroud segment 35. The segment 35 is one of a plurality which collectively from an annular shroud around a turbine rotor. The turbine rotor comprises a plurality of blades 36 arranged in a circumferential array on an annular platform 37 which encircles the circumference of a rotor disc 38. The rotor disc 38 is arranged for rotation about the axis C-C. A clearance space 39 exists between shroud segments 35 and tips of the blades 36. Whilst such a clearance is important to avoid impairment of the rotation of the blades 36, for optimum turbine efficiency, the clearance space 39 should be kept to a minimum avoiding leakage of working fluid directed at the blades 36.

The dimension of the clearance space 39 during various operational stages of the engine is achieved by thermal resizing of the annular casing 33. Thermal resizing is achieved by heating or cooling the casing 33 by means of introduction of a heating or cooling fluid into the manifold 31. The rate of heating or cooling is controlled by controlling the rate of flow of the heating or cooling fluid delivered to the outlet segments 32 by means of the previously described valve 24 and flow restrictor plates 22*a* and 23*a*. As the annular casing 33 expands or contracts, the strut segments 34 are caused to move in a radial direction thereby closing or opening the clearance space 39 as required.

Figure 4:
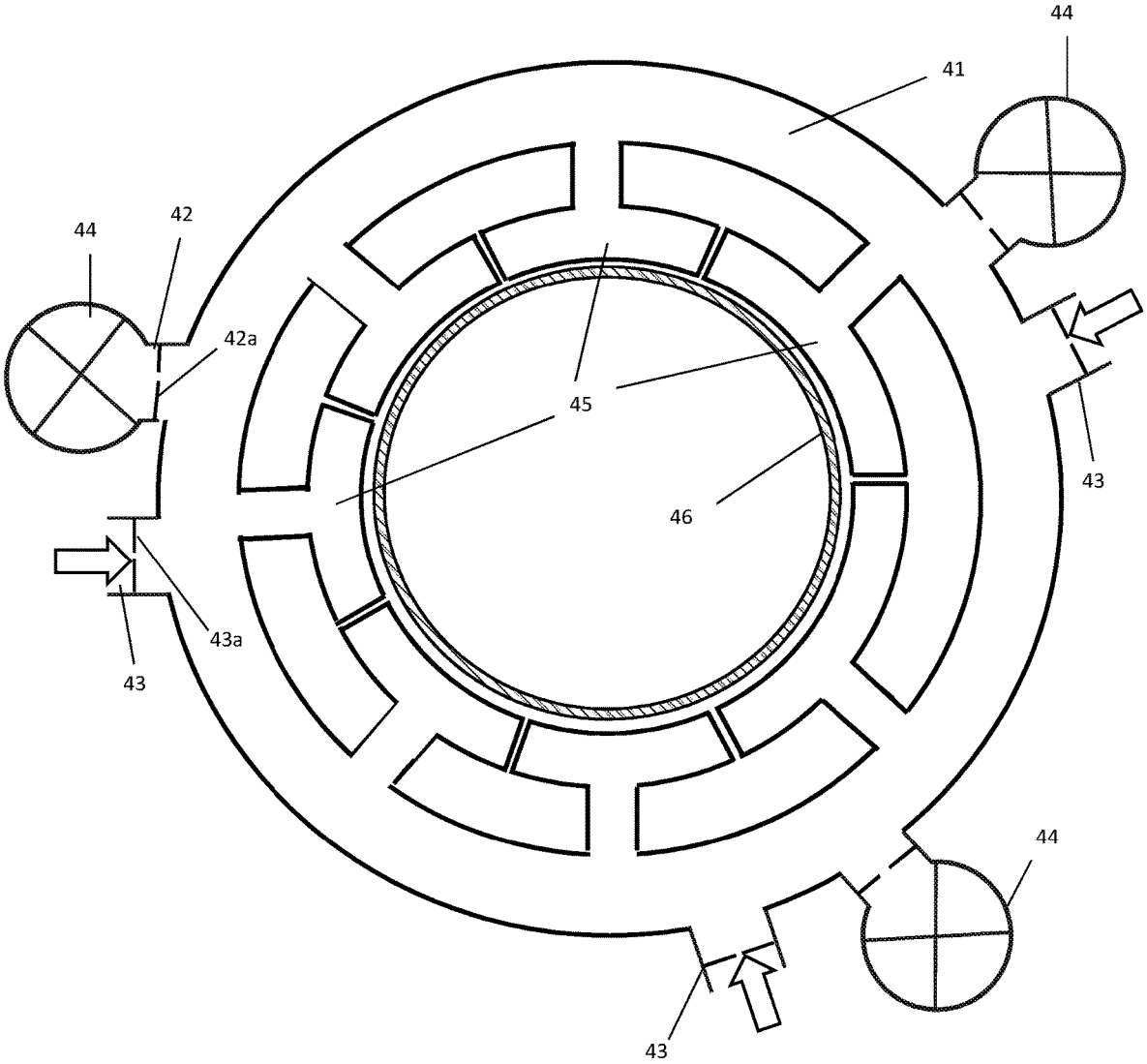
FIG. 4 shows a schematic of a second embodiment of a turbine case cooling system in accordance with the present disclosure.

FIG. 4 shows an alternative embodiment of a cooling system in accordance with the present disclosure. The arrangement is broadly similar to that of FIG. 2, though in contrast to the arrangement of FIG. 2, the manifold 41 is provided with multiple pairs of first and second inlets 42, 43. The inlets 42, 43 are each obstructed by a flow restrictor plate 42*a*, 43*a*. As in the previously described embodiment, the manifold 41 connects with radially inwardly directed outlets 45 which are arranged radially adjacent and in thermal communication with the annular casing 46. The pairs of inlets 42, 43 may optionally be supplied from a single feed (not shown). Alternatively, pairs of inlets 42, 43 may be supplied from multiple different feeds (not shown).

Figure 5:
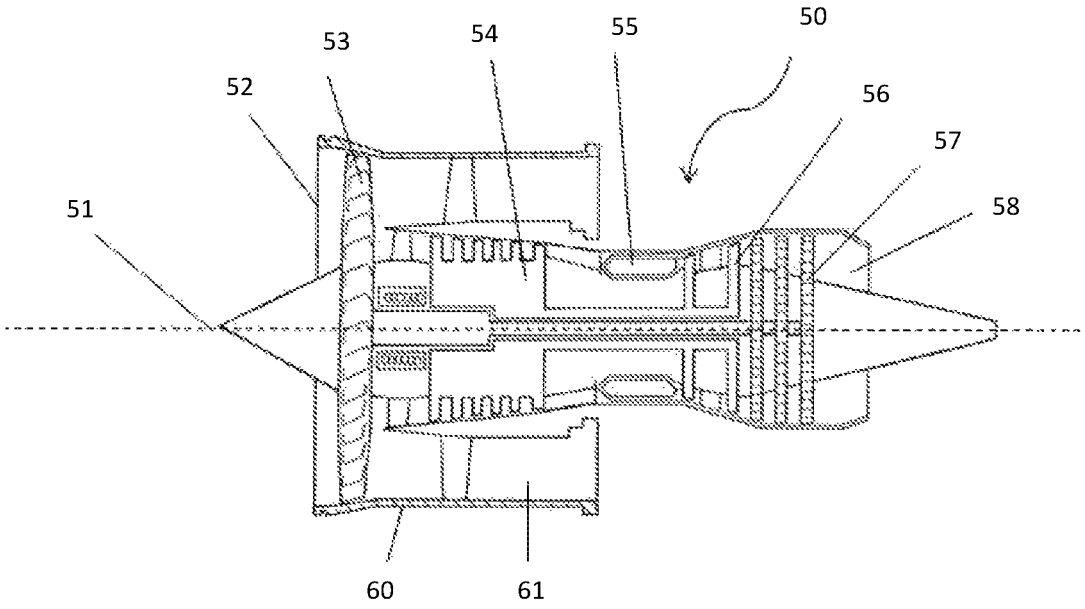
FIG. 5 illustrates a gas turbine engine having a configuration into which a control system in accordance with the present disclosure might usefully be embodied.

With reference to FIG. 5, a gas turbine engine is generally indicated at 50, having a principal and rotational axis 51. The engine 50 comprises, in axial flow series, an air intake 52, a propulsive fan 53, a high-pressure compressor 54, combustion equipment 55, a high-pressure turbine 56, a low-pressure turbine 57 and an exhaust nozzle 58. A nacelle 60 generally surrounds the engine 50 and defines the intake 52.

The gas turbine engine 50 works in the conventional manner so that air entering the intake 52 is accelerated by the fan 53 to produce two air flows: a first air flow into the high-pressure compressor 54 and a second air flow which passes through a bypass duct 61 to provide propulsive thrust. The high-pressure compressor 54 compresses the air flow directed into it before delivering that air to the combustion equipment 55.

In the combustion equipment 55 the air flow is mixed with fuel and the mixture combusted. The resultant hot combustion products then expand through, and thereby drive the high and low-pressure turbines 56, 57 before being exhausted through the nozzle 58 to provide additional propulsive thrust. The high 56 and low 57 pressure turbines drive respectively the high pressure compressor 54 and the fan 53, each by suitable interconnecting shaft.

For example, a turbine casing cooling system in accordance with the present disclosure may be arranged around a casing of the low pressure turbine 57.

Other gas turbine engines to which the present disclosure may be applied may have alternative configurations. By way of example such engines may have an alternative number of interconnecting shafts (e.g. three) and/or an alternative number of compressors and/or turbines. Further the engine may comprise a gearbox provided in the drive train from a turbine to a compressor and/or fan.

Benefits of embodiments of the present disclosure are expected to include:

- Opportunity to tune the system more quickly: flow restrictor plates and can changed quickly on test and adjusted until an optimum system is achieved.
- An improved flow area control during cruise operations due to the flow area tolerance being much smaller than the impingement holes of the prior art.
- Reduced in complexity of the valve to a simple open/closed configuration resulting in consequent cost and weigh reductions.
- Enablement of on wing adjustment for deterioration by increasing the flow through both feeds.
- The absence of a valve control on the second inlet reduces risk of the flow not being provided at take-off due to a valve failure.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A turbine case cooling system comprising:

an annular turbine case having a radially outer surface;

a manifold radially adjacent to a portion of the radially outer surface of the annular turbine case, the manifold being in fluid communication with one or more of radially inwardly directed outlets; and a first inlet connected to the manifold and a second inlet connected to the manifold, wherein:

the first inlet is obstructed by a first flow restrictor and the second inlet is obstructed by a second flow restrictor; and the first inlet includes a valve upstream of the first flow restrictor such that the flow restrictor is disposed between the valve and the manifold, the valve being configured to control flow of fluid supply entering the first inlet.

2. The turbine case cooling system as claimed in claim 1, wherein at least one of the first or second flow restrictors is in the form of perforated plates that are configured to be removably retained in the region of the inlets.

3. The turbine case cooling system as claimed in claim 1, wherein the valve is incrementally adjustable for a range of flows.

4. The turbine case cooling system as claimed in claim 1, wherein the valve has only an open and a closed configuration.

5. The turbine case cooling system as claimed in claim 1, wherein the manifold completely encircles the turbine case.

6. The turbine case cooling system as claimed in claim 1, wherein the manifold is one of a plurality of manifolds, each manifold having an arcuate configuration and arranged around a circumference of the turbine case, and each arcuate manifold having a first inlet and a second inlet.

7. The turbine case cooling system as claimed in claim 6, wherein the flow restrictors are differently configured for different manifolds such that variable flows are arranged around the circumference of the turbine case.

8. The turbine case cooling system as claimed in claim 1, wherein the inlets are provided in fluid communication with an upstream compressor.

9. The turbine case cooling system as claimed in claim 1, further comprising a controller configured to control the valve whereby to adjust flow of fluid entering the manifold during different operational stages of the turbine.

10. The turbine case cooling system as claimed in claim 9, wherein the controller is configured to close the valve during a maximum take-off operation of the turbine and to open the valve during a cruise operation of the turbine.

11. The turbine case cooling system as claimed in claim 10, wherein the turbine case cooling system is arranged radially adjacent a low-pressure turbine stage of a gas turbine engine.

12. A gas turbine engine comprising one or more turbine case cooling systems, the turbine case cooling system having a configuration as set forth in claim 1.

* * * * *